United States Patent [19]

Cottingham

[11] 4,362,250

[45] Dec. 7, 1982

[54] CONTAINER FOR STORING REACTIVE OR VOLATILE MATERIAL

[75] Inventor: Auburn B. Cottingham, Cincinnati, Ohio

[73] Assignee: National Distillers & Chemical Corp., New York, N.Y.

[21] Appl. No.: 247,660

[22] Filed: Mar. 26, 1981

[51] Int. Cl.[3] ..... B65D 41/04

[52] U.S. Cl. ..... 215/247; 206/525; 215/31; 215/277

[58] Field of Search ..... 215/31, 34, 277, 247; 220/256; 206/524.1, 525

[56] References Cited

U.S. PATENT DOCUMENTS

| | | | |
|---|---|---|---|
| 605,482 | 6/1898 | Jaggard | 215/302 |
| 695,044 | 3/1902 | Gibson | 215/34 |
| 765,745 | 7/1904 | Margetts | 215/31 |
| 2,093,189 | 9/1937 | Edmunds | 215/31 |
| 2,311,983 | 2/1943 | Gora | 215/341 |
| 2,337,616 | 12/1943 | McManus et al. | 220/256 |
| 2,364,126 | 12/1944 | Cantor et al. | 215/247 |
| 2,629,379 | 2/1953 | Fields | 215/277 X |

FOREIGN PATENT DOCUMENTS

| | | | |
|---|---|---|---|
| 459203 | 9/1950 | Italy | 215/277 |

*Primary Examiner*—Donald F. Norton
*Attorney, Agent, or Firm*—Kenneth D. Tremain

[57] ABSTRACT

A container having a dual-neck configuration providing inner and outer seals for reactive or volatile materials stored therein. An inner cylindrical neck provides the inner seal, and is surrounded by an outer neck providing the outer seal. Inner and outer caps are threaded onto the respective inner and outer necks, and each cap is provided with an elastomeric liner. The inner cap is further provided with an axial bore to allow a hollow needle to pass therethrough, thereby enabling material within the container to be withdrawn through the needle, and the inner elastomeric seal reseals itself after withdrawal of the needle.

7 Claims, 3 Drawing Figures

CONTAINER FOR STORING REACTIVE OR VOLATILE MATERIAL

BACKGROUND OF THE INVENTION

1. Field of the Invention

The present invention relates generally to a container for chemical materials and, more particularly pertains to a reusable container for storage of volatile or highly reactive materials having a unique double-neck configuration.

Volatile or highly reactive chemicals are commonly and extensively used in laboratories throughout the world. These types of chemicals, when brought into contact with the atmosphere or environment, normally react rapidly and undesirably therewith. Accordingly it is necessary to store such chemical materials in containers which are capable of isolating their contents from the environment. Further, these containers must also have the ability to allow for dispensing of desired quantities of chemical material without exposing the undispensed portion thereof to the atmosphere.

2. Discussion of the Prior Art

As is well known in the prior art, glass bottles are frequently used for the storage and isolation of volatile chemicals. Many prior art containers are further provided with permanently affixed sealing arrangements. However, a major problem associated with many currently employed prior art sealing arrangements is the inherent non-reusability of the containers. The structure for isolating the contents of the container from the atmosphere is normally permanently affixed to the container through the intermediary of a complicated device, thereby rendering reuse of the container difficult, if not impossible, and economically unfeasible.

Another major problem associated with various prior art containers of the above-mentioned type is the continued isolation of their chemical contents during extended periods of shelf storage. Upon withdrawal of a portion of the chemicals in the container, seepage of the unused portion of the contents frequently occur over extended periods of storage. Generally, prior art containers do not effectively prevent seepage of this kind and reaction of the released chemicals with the atmosphere.

The present invention effectively solves both of the aforementioned problems while providing a remarkably simple and inexpensive container. None of the prior art arrangements solve the aforementioned problems, nor do any even remotely suggest a dual-neck configuration as disclosed herein. None of the prior art, of which Tuuri U.S. Pat. No. 3,265,233, Law U.S. Pat. No. 3,269,576 and DeBaun U.S. Pat. No. 2,732,104 are typical, suggest the functionability or desirability of the sealing arrangement of the present invention.

Tuuri U.S. Pat. No. 3,265,233, illustrates in FIG. 5 thereof a dual closure single-neck arrangement wherein a closure element has an internally threaded skirt portion for threaded engagement with the neck of the container. A second closure element is axially and rotatably movable, and is provided with a sealing wall. Unlike the present invention, the closure configuration of this reference is particularly designed to complicate the opening of the container to prevent its inadvertent opening by a child. This arrangement provides only a single barrier between the contents and the environment without the provision of an isolating seal, and accordingly communication between the atmosphere and contents is likely to occur. Unlike the present invention, the arrangement disclosed by this patent is directed towards keeping the container closed, rather than maintaining the contents thereof completely isolated from the environment.

Law U.S. Pat. No. 3,269,576 is also directed towards a closure arrangement for preventing the inadvertent opening of a container by a child. A central plug or stud is provided at one end with internal threads which engage external threads of a single-neck container. External threads at the second end of the plug are adapted to engage internal threads within the neck of the container. By unthreading the external threads of the plug, it can then be pulled up to engage the internal threads of the neck to completely remove the plug. Like Tuuri, this closure arrangement is designed to effectively complicate the opening of the container. Accordingly this patent is not believed to be particularly relevant to the present invention, but a discussion thereof is included herein to exemplify the present state of the general container closure art. Unlike the present invention, a seal is not provided to isolate the contents of the container from the atmosphere. Additionally, upon the dispensing of any of the contents therein, the unused portion remains in communication with the atmosphere, thereby not achieving the general objects of the present invention.

DeBaun U.S. Pat. No. 2,732,104 discloses a dosage administering bottle for simply dispensing powders, and although not considered particularly pertinent to the present invention, a brief discussion thereof is included to illustrate the present state of the art.

The Aldrich Chemical Co. has designed a new bottle which attempts to solve many of the problems discussed above and, accordingly, the Aldrich bottle is considered to be somewhat more pertinent with respect to the present inventive concept. The bottle and sealing arrangement is presently commercially available with reagent contained therein but not just as a bottle per se, and is referred to under the commercial or tradename SURE/SEAL SYSTEM. The container with contents is commercially obtainable from the Aldrich Chemical Co. of Milwaukee, Wisconsin, and includes a specially designed single neck having a glass crown and outer threads. A metal crown cap with an elastomeric liner is crimped onto the glass crown of the bottle, and is provided with a small aperture therethrough. A Bakelite plastic cap also having an elastomeric liner is then threaded onto the external threads of the glass crown directly over the metal crown. Accordingly, the Aldrich container provides a relatively effective sealing arrangement for its contents. To withdraw a desired amount of chemicals from the container, the Bakelite cap is first removed, and a needle is then inserted through the hole in the metal crown. The needle pierces the elastomeric liner of the crown to allow chemicals to be withdrawn therethrough. After a desired quantity of chemicals is extracted through the needle, it is withdrawn and the elastomeric liner then effectively reseals itself. Leakage through the needle puncture, which conceivably may occur during long-term storage, is prevented by replacement of the Bakelite cap, which positions the elastomeric liner of the cap over the hole in the metal crown. Consequently, the unpierced elastomeric liner of the cap provides an effective seal to thereby prevent seepage of the stored chemicals and to preclude reaction thereof with the atmosphere or the environment. The Aldrich bottle, however, is subject to several of the disadvantages mentioned hereinabove. In greater particularity, the Aldrich bottle is not an easily reusable type of container but may be reused with a new elastomeric liner crimped to the glass crown, which effectively restricts its usage in many commercial and laboratory applications. The inherent nonreusability of the Aldrich bottle is a significant drawback in many storage applications wherein reusability of the container is an essential or primary requirement, especially from a cost/benefit ratio viewpoint.

SUMMARY OF THE INVENTION

Accordingly, it is a primary object of the present invention to provide an improved reusable storage container of the type described for storing and isolating reactive or volatile materials.

Another significant object of the present invention is the provision of a container which effectively seals reactive materials relative to the environment and, moreover is relatively inexpensive to manufacture and reuse.

A further object of the invention is to provide a novel container which isolates an unused portion of reactive material stored therein from the environment during prolonged periods of shelf storage.

The present invention provides a novel container for storing volatile materials which is provided with a double-neck configuration so as to allow for multiple sealing of the container.

The inventive double-neck arrangement of the container effectively isolates stored chemical material from the environment while concurrently allowing for the removal of desired quantities of chemicals from the container without exposing the unused portion therein to the atmosphere.

In accordance with a preferred embodiment of the invention, a reusable container is disclosed having an opening to provide access to materials stored therein and which is provided with inner and outer container sealing arrangements. A cylindrical inner neck is positioned around the access opening, extending therefrom, and provides for an inner seal for the container. A cylindrical outer neck is positioned around the inner cylindrical neck, coaxially with respect thereto, and provides for an outer seal for the container.

Furthermore, each of the inner and outer cylindrical necks of the container is externally threaded, and an inner cap having internal threads is provided for threaded engagement with the inner cylindrical neck, while an internally threaded outer cap is provided for threaded engagement with the outer neck. Moreover, each of the inner and outer caps includes an elastomeric seal, and the inner cap has at least one bore extending through its upper cap surface so as to allow an eedle to be inserted therethrough. The elastomeric seal for the inner cap is capable of being pierced by a needle, and of resealing itself after withdrawal thereof. Moreover, the elastomeric liner of the outer cap provides a second, outer seal for the container, thereby preventing any leakage of material which may seep through punctures in the inner seal into the atmosphere or environment. In accordance with another aspect of the present invention, the inner cylindrical neck extends from the container for a smaller distance than the outer cylindrical neck, thereby recessing the inner neck with respect to the outer neck, and with the inner cap being selectively shaped for engagement by a correspondingly shaped socket wrench or other tool for the tightening or loosening thereof, preferably by hand.

BRIEF DESCRIPTION OF THE DRAWINGS

The foregoing and other objects, advantages and characterizing features of the inventive container described herein will become more readily apparent from the following detailed description of a preferred embodiment thereof, taken in conjunction with the accompanying drawings wherein like reference numerals denote similar parts throughout the various views, and in which.

DESCRIPTION OF THE PREFERRED EMBODIMENTS

Figure 1:
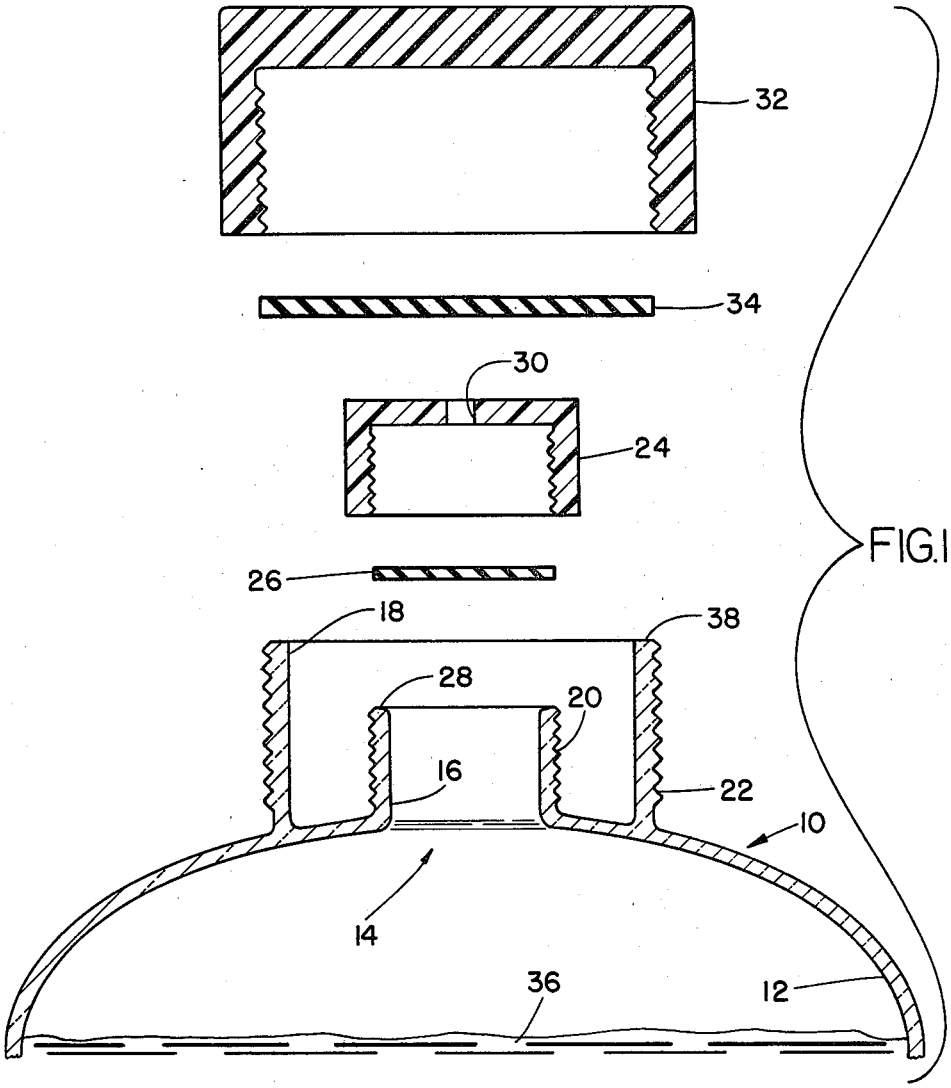
FIG. 1 is an exploded, sectional elevational view of one embodiment of the present invention for a reusable container having inner and outer sealing caps.

Referring now to the drawings in detail, FIG. 1 illustrates a container 10 constructed in accordance with the teachings of the present invention. The container is constructed of an integrally formed piece of glass or other appropriate inert material such as a suitable polymer plastic, ceramic, metal, etc., and includes a main container body 12 for storing material therein and a circular top opening 14 for providing access to the contents thereof. An inner cylindrical neck 16 is provided around the access opening 14 extending therefrom, and is formed integrally with the main container body 12. An outer cylindrical neck 18, positioned coaxially with respect to the inner neck 16, is also formed integrally with the main container body 12. The inner and outer necks are provided with external threads therearound, respectively 20 and 22.

Figure 2:
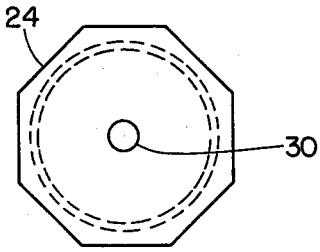
FIG. 2 is a plan view of the inner cap shown in FIG. 1.

The container is adapted to receive an inner cap 24 with an elastomeric lining 26 threadedly onto the external threads 20 of the inner neck 16. The elastomeric lining 26 effectively seals the inner neck around its upper annular surface 28. The inner cap is further provided with at least one small circular bore 30 which passes completely through the upper surface of the cap 24. As also shown in FIG. 2, the inner cap has an octagonal shape to facilitate tightening or loosening thereof with a socket wrench or other suitable fastening tool. An outer plastic cap 32 is provided as an outer seal for the container and threadedly engages the external threads 22 on the outer cylindrical neck 18. The outer cap 32 is rovided with an inner elastomeric seal 34. The top annular surface 28 of the inner neck 16 is recessed a distance d with respect to the top annular surface 38 of the outer neck 18. The recessed distance d is designed to be substantially the total thicknesses of the top of the inner cap 24 and the inner seal 26 such that tightening of outer cap 32 causes its seal 34 to seal against the top of the inner cap 24 and the top annular edge 38. Accordingly, when the outer cap 32 is threadedly tightened onto the bottle 10, its seal 34 effectively seals the container 10 and the reactive material 36 therein at the top of inner cap 24 and at the top annular edge 38 of outer cylindrical neck 18.

In operation, the bottle 10 is filled with material 36 which may consist of or include active reagents or highly volatile chemical materials under an inert atmosphere. The inner cap 24 is then threaded onto the inner neck 16 by means of threads 20. The inner cap may be tightened manually or through the application thereto of a suitable tool or the contents may be added in the open atmosphere through elastomer 26 via a syringe needle or cannula after the inner cap 24 is attached. The outer cap 32 is then threaded onto the outer neck 18 through external threads 22, and is hand-tightened so as to ensure that the elastomeric lining 34 snugly engages the outer neck 18 along its upper annular edge 38, and also the top of the inner cap 24.

Material 36 may be withdrawn from the container 10 in the following manner. The outer cap 32 is first unscrewed from the container, thereby allowing a hollow needle to be inserted through bore 30 and elastomeric lining 26 into the stored material 36. A desired quantity of material is then extracted through the needle, and the needle is thereafter withdrawn through the liner 26, temporarily leaving a small puncture hole formed therein. Normally, the elastomeric liner 26 reseals itself, thereby maintaining a complete isolation of the material 36 from the atmosphere. Repeated usage of a needle for withdrawal of material results in the formation of numerous small puncture holes in liner 26. Seepage of material 36 may then take place through these numerous puncture holes, particularly during prolonged periods of shelf storage of the container. The outer cap 32 is therefore provided as a second and outer seal between the stored material 36 and the atmosphere. Alternatively, if a large quantity of stored material is to be dispensed, the inner cap 24 can be removed completely from the container, and the stored material may be simply poured therefrom with or without a protective atmosphere.

Figure 3:
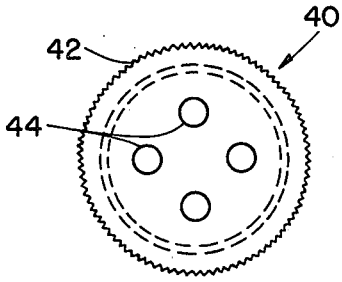
FIG. 3 illustrates a plan view of a further embodiment of an inner cap pursuant to the teachings herein.

FIG. 3 is a plan view of a further embodiment of an inner cap 40 which has a multiribbed circumference 42 for engagement with a corresponding multiribbed tightening/loosening tool or for engagement by hand. In some embodiments a friction fit with the inner cap may be sufficient, and would additionally serve to act as a clutch mechanism to prevent overtightening thereof. Moreover, inner cap 40 has a multiple number of apertures 44 extending through its upper surface to provide a multiple number of locations at which an extraction needle may be inserted through the elastomeric liner into the bottle. It is contemplated within the teachings of the present invention that the size and or number of bores or access apertures may vary from embodiment to embodiment, depending upon the particular requirements thereof.

The reusability of the container of the present invention is self-evident from the foregoing description. The contents of the container can be easily removed, and the container 10 can be refilled simply by removal of both inner and outer caps or by the use of a cannula or needle with the inner cap 24 in place and provision for pressure relief therein. Furthermore, the inner elastomeric liner 26 is easily replaceable after receiving a number of puncture holes therein. Accordingly the present invention provides a simple and reusable container which is highly effective in the containment and storage of reactive or volatile chemicals.

From the foregoing, it is apparent that the objects of the present invention have been fully accomplished. As a result of the present invention there has thus been provided a novel container for storing reactive or volative materials. Although a preferred embodiment incorporating the principles of this invention has been described and illustrated in detail, it should be realized by one skilled in the art that the teachings herein are not limited to the particular configuration illustrated in the drawings, and that modifications thereof are contemplated and can be readily effected without departing from the broad spirit and scope of this invention.

What is claimed is:

1. A reusable container provided with inner and outer seals for material stored therein, comprising:

(a) a container body having an access opening providing access to the material stored therein;

(b) a substantially cylindrical outer neck extending about said access opening and projecting from the container body as an integral part therewith, said outer neck having external threads formed therearound such that it is adapted to form an outer seal for the container; and (c) a substantially cylindrical inner neck extending from said container body as an integral part therewith and being in spaced relationship within said outer cylindrical neck and being arranged coaxially relative thereto, said inner cylindrical neck having external threads formed therearound such that it is adapted to form an inner seal for the container, and said inner cylindrical neck projecting from the container body for a distance less than that of the outer cylindrical neck so as to have the inner cylindrical neck recessed within the outer cylindrical neck, whereby an inner cap can be threadedly engaged over said inner cylindrical neck to provide an inner seal therefor, and an outer cap can be threadedly engaged over said outer cylindrical neck to provide an outer seal over both the inner cap and the outer cylindrical neck.

2. A reusable container as claimed in claim 1, in combination with an inner cap having internal threads for threaded engagement with said inner cylindrical neck; and an outer cap having internal threads for threaded engagement with said outer cylindrical neck.

3. A reusable container as claimed in claim 2, comprising an elastomeric seal for each of said inner and outer caps.

4. A reusable container as claimed in claim 3, said distance that the inner cylindrical neck projects less than that of the outer cylindrical neck being substantially equal to the sum of the thickness of the top of the inner cap and the thickness of the elastomeric seal for the inner cap, such that tightening of the outer cap causes its elastomeric seal to seal against both the top of the inner cap and the top annular edge of the cylindrical outer neck.

5. A reusable container as claimed in claim 2 or 3, said inner cap having an irregular peripheral shape for engagement by a corresponding irregularly shaped tool.

6. A reusable container as claimed in claim 3 or 4, said inner cap having at least one aperture extending through its upper surface to facilitate a hollow needle to be inserted therethrough, said elastomeric seal for the inner cap being adapted to be pierced by the needle and resealing itself after withdrawal of the needle.

7. A reusable container as claimed in claim 1 or 2 or 3 or 4, containing therein a volatile or highly reactive chemical material, for which the container must provide a secure seal to isolate it from the surrounding environment.

* * * * *